US011927187B2

(12) United States Patent
Clendenin et al.

(10) Patent No.: US 11,927,187 B2
(45) Date of Patent: Mar. 12, 2024

(54) COMPRESSOR HAVING A BUSHING ASSEMBLY

(71) Applicant: Copeland LP, Sidney, OH (US)

(72) Inventors: Harry B. Clendenin, Sidney, OH (US); Dennis D. Pax, Piqua, OH (US); Larry L Bingham, Greenville, OH (US); Keith J. Reinhart, Troy, OH (US); Nicholas J. Altstadt, Somerset, KY (US)

(73) Assignee: Copeland LP, Sidney, OH (US)

( * ) Notice: Subject to any disclaimer, the term of this patent is extended or adjusted under 35 U.S.C. 154(b) by 0 days.

(21) Appl. No.: 17/352,074

(22) Filed: Jun. 18, 2021

(65) Prior Publication Data

US 2022/0403844 A1 Dec. 22, 2022

(51) Int. Cl.

| | |
|---|---|
| ***F04C 18/02*** | (2006.01) |
| ***F04C 23/00*** | (2006.01) |
| ***F04C 29/00*** | (2006.01) |

(52) U.S. Cl.

CPC ..... *F04C 18/0215* (2013.01); *F04C 29/0021* (2013.01); *F04C 18/0207* (2013.01);

(Continued)

(58) Field of Classification Search

CPC ..... F04C 18/0215; F04C 2240/56; F04C 2240/805; F04C 29/0021; F04C 18/0207;

(Continued)

(56) References Cited

U.S. PATENT DOCUMENTS

| | | | | |
|---|---|---|---|---|
| 5,141,407 | A | 8/1992 | Ramsey et al. | |
| 5,346,136 | A * | 9/1994 | Bassett | F16J 15/004 239/533.2 |

(Continued)

FOREIGN PATENT DOCUMENTS

| | | | |
|---|---|---|---|
| KR | 20110096367 | A | 8/2011 |
| WO | WO-2019089956 | A1 | 5/2019 |

OTHER PUBLICATIONS

English Machine Translation of KR 10-2011-0096367 via USPTO Fit Datebase on Sep. 7, 2023 (Year: 2011).*

(Continued)

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A compressor includes a shell, a bearing housing, an orbiting scroll, a non-orbiting scroll and a spacer. The bearing housing includes a central body and a plurality of arms extending radially outwardly from the central body. Each of the arms has a first aperture. The non-orbiting scroll is meshingly engaged with the orbiting scroll and includes a plurality of second apertures. Each second aperture receives a bushing defining a first longitudinal axis and a fastener defining a second longitudinal axis. The fastener extends through the bushing and into a corresponding one of the first apertures in the bearing housing. The spacer is disposed between the bushing and the fastener of each second aperture and is configured to engage one of the bushing and the fastener to restrict radial misalignment between the first longitudinal axis of the bushing and the second longitudinal axis of the fastener.

14 Claims, 8 Drawing Sheets

(52) U.S. Cl.
CPC ..... *F04C 18/0246* (2013.01); *F04C 18/0253* (2013.01); *F04C 23/008* (2013.01); *F04C 2240/56* (2013.01); *F04C 2240/805* (2013.01)

(58) Field of Classification Search
CPC . F04C 18/0246; F04C 18/0253; F04C 23/008
See application file for complete search history.

(56) References Cited

U.S. PATENT DOCUMENTS

| | | | | |
|---|---|---|---|---|
| 5,580,230 | A * | 12/1996 | Keifer | G01M 99/00 418/57 |
| 5,609,478 | A | 3/1997 | Utter et al. | |
| 7,322,807 | B2 * | 1/2008 | Clendenin | F01C 21/003 418/57 |
| 9,689,391 | B2 * | 6/2017 | Fu | F04C 29/063 |
| 10,458,409 | B2 * | 10/2019 | Su | F04C 29/0021 |
| 10,458,509 | B2 * | 10/2019 | Kobayashi | F16F 9/465 |
| 2013/0142588 | A1 | 6/2013 | Slater et al. | |
| 2013/0287617 | A1 * | 10/2013 | Siefring | F04C 18/0207 418/55.1 |
| 2015/0152868 | A1 * | 6/2015 | Fu | F04C 29/0021 418/55.5 |
| 2020/0109734 | A1 * | 4/2020 | Slater | F16B 19/02 |

OTHER PUBLICATIONS

International Search Report regarding Application No. PCT/US2022/030325 dated Sep. 14, 2022.
Written Opinion of the ISA regarding Application No. PCT/US2022/030325 dated Sep. 14, 2022.

* cited by examiner

COMPRESSOR HAVING A BUSHING ASSEMBLY

FIELD

The present disclosure relates to a compressor having a bushing assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, one or more indoor heat exchangers, one or more expansion devices disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that includes a shell, a bearing housing, an orbiting scroll, a non-orbiting scroll and a spacer. The bearing housing is supported within the shell. The bearing housing includes a central body and a plurality of arms extending radially outwardly from the central body. Each of the arms has a first aperture. The orbiting scroll is supported on the bearing housing. The non-orbiting scroll is meshingly engaged with the orbiting scroll and includes a plurality of second apertures. Each second aperture receives a bushing defining a first longitudinal axis and a fastener defining a second longitudinal axis. The fastener extends through the bushing and into a corresponding one of the first apertures in the bearing housing to rotatably secure the non-orbiting scroll relative to the bearing housing. The spacer is disposed between the bushing and the fastener of each second aperture and configured to engage one of the bushing and the fastener to restrict radial misalignment between the first longitudinal axis of the bushing and the second longitudinal axis of the fastener.

In some configurations of the compressor of the above paragraph, the spacer is coupled to the fastener and is configured to engage the bushing to restrict radial misalignment between the first longitudinal axis of the bushing and the second longitudinal axis of the fastener.

In some configurations of the compressor of any one or more of the above paragraphs, the fastener includes a threaded portion and an unthreaded portion. The spacer is coupled to the unthreaded portion of the fastener.

In some configurations of the compressor of any one or more of the above paragraphs, the fastener includes a threaded portion and an unthreaded portion. The spacer is coupled to the threaded portion of the fastener.

In some configurations of the compressor of any one or more of the above paragraphs, the spacer is coupled to the threaded portion and the unthreaded portion of the fastener.

In some configurations of the compressor of any one or more of the above paragraphs, the fastener includes a threaded portion and an unthreaded portion. The spacer is disposed within an annular groove formed in an outer diametrical surface of the unthreaded portion.

In some configurations of the compressor of any one or more of the above paragraphs, the spacer is coupled to the bushing and is configured to engage the fastener to restrict radial misalignment between the first longitudinal axis of the bushing and the second longitudinal axis of the fastener.

In some configurations of the compressor of any one or more of the above paragraphs, the bushing includes an inner diametrical surface having an annular groove formed therein. The spacer is disposed within the annular groove.

In some configurations of the compressor of any one or more of the above paragraphs, the spacer extends radially inwardly from an inner diametrical surface of the bushing and is configured to engage an unthreaded portion of the fastener.

In some configurations of the compressor of any one or more of the above paragraphs, the spacer is a coiled wire.

In some configurations of the compressor of any one or more of the above paragraphs, the spacer is a nut.

In some configurations of the compressor of any one or more of the above paragraphs, the spacer is a split spring bushing.

In some configurations of the compressor of any one or more of the above paragraphs, the spacer is integrally formed with one of the bushing and the fastener.

In some configurations of the compressor of any one or more of the above paragraphs, the first spacer is a continuous, annular bushing.

In another form, the present disclosure provides a compressor that includes a shell, a bearing housing, a non-orbiting scroll, an orbiting scroll, a plurality of bushings, a plurality of fasteners and a plurality of first spacers. The bearing housing is fixed within the shell. The bearing housing includes a central body and a plurality of arms extending radially outward from the central body. Each of the arms has a first aperture. The non-orbiting scroll includes a plurality of second apertures. The orbiting scroll is supported on the bearing housing and is meshingly engaged with the non-orbiting scroll. The plurality of bushings each has a third aperture. Each of the second apertures in the non-orbiting scroll receives one of the bushings. The plurality of fasteners rotatably securing the non-orbiting scroll relative to the bearing housing. Each of the fasteners extends through the third aperture of a corresponding bushing and is received in a corresponding one of the first apertures in the bearing housing. Each of the first spacers is received in the third aperture of a corresponding bushing and is configured to engage one of the corresponding bushing and a corresponding fastener to restrict radial misalignment between a first longitudinal axis of the corresponding bushing and a second longitudinal axis of the corresponding fastener.

In some configurations of the compressor of the above paragraph, a clearance gap is defined by at least a portion of the bushing and at least a portion of a respective spacer.

In some configurations of the compressor of any one or more of the above paragraphs, each of the first spacers is a coiled wire.

In some configurations of the compressor of any one or more of the above paragraphs, each of the first spacers is a split spring bushing.

In some configurations of the compressor of any one or more of the above paragraphs, each of the first spacers is a continuous, annular bushing.

In some configurations of the compressor of any one or more of the above paragraphs, the spacer is integrally formed with one of the bushing and the fastener.

In some configurations of the compressor of any one or more of the above paragraphs, the compressor further includes a plurality of second spacers. Each of the second spacers is received in the third aperture of a corresponding bushing and contacts a surface of a corresponding arm of the bearing housing.

In some configurations of the compressor of any one or more of the above paragraphs, the first spacer contacts the second spacer inside each third aperture.

In some configurations of the compressor of any one or more of the above paragraphs, the first spacers are made of a first material and the second spacers are made of a second material. The first material has a higher rigidity than the second material.

In some configurations of the compressor of any one or more of the above paragraphs, a distance between the surface of the corresponding arm of the bearing housing and a location along a length of the fastener that the first spacer is coupled to the fastener is determined by an axial length of the second spacer.

In another form, the present disclosure provides a compressor that includes a shell, a bearing housing, a non-orbiting scroll, an orbiting scroll, a plurality of bushings, a plurality of fasteners and a plurality of spacers. The bearing housing is fixed within the shell. The bearing housing includes a central body and a plurality of arms extending radially outward from the central body. Each of the arms has a first aperture. The non-orbiting scroll includes a plurality of second apertures. The orbiting scroll is supported on the bearing housing and is meshingly engaged with the non-orbiting scroll. The plurality of bushings each has a third aperture. Each of the second apertures in the non-orbiting scroll receives one of the bushings. The plurality of fasteners rotatably securing the non-orbiting scroll relative to the bearing housing. Each of the fasteners extends through the third aperture of a corresponding bushing and is received in a corresponding one of the first apertures in the bearing housing. Each of the spacers received in the third aperture of a corresponding bushing and received in a corresponding first aperture and configured to engage one of the corresponding bushing and the bearing housing to restrict radial misalignment between a first longitudinal axis of the corresponding bushing and a second longitudinal axis of the corresponding third aperture.

In some configurations of the compressor of the above paragraph, each of the spacers is partially received in a counterbore of the corresponding bushing and partially received in a counterbore of the corresponding first aperture.

In some configurations of the compressor of either of the above paragraphs, the spacers could be coiled wires, split spring bushing, or continuous, annular bushings, for example.

In some configurations of the compressor of any one or more of the above paragraphs, the spacer is integrally formed with one of the bushing and the fastener.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
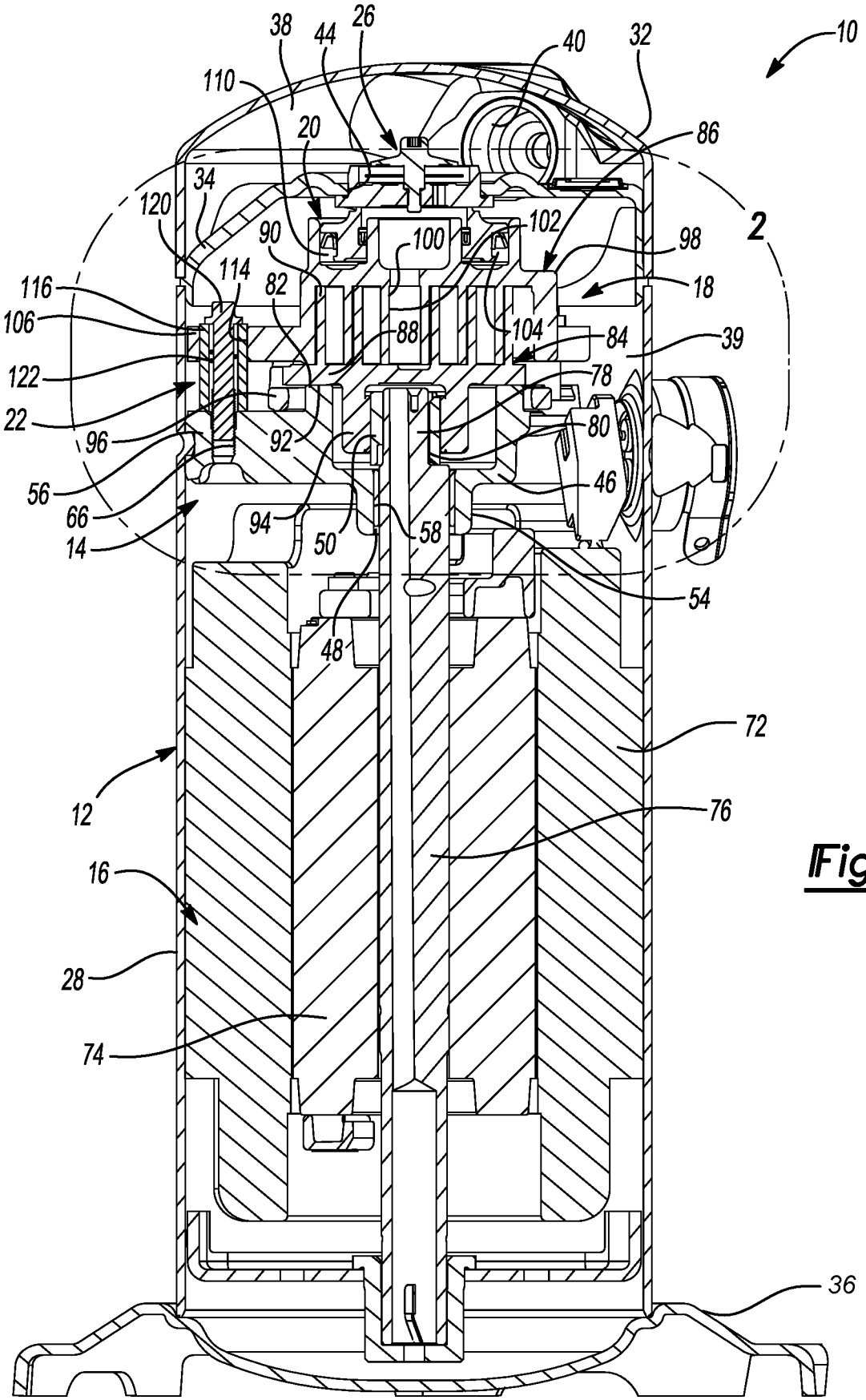
FIG. 1 is a cross-sectional view of a compressor having bushing assemblies according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The principles of the present disclosure are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and at least a portion of the compression mechanism are disposed in a suction-pressure region of the compressor, as illustrated in FIG. 1. It will be appreciated that the principles of the present disclosure are also applicable to high-side compressors (i.e., compressors having the motor and compression mechanism disposed in a discharge-pressure region of the compressor).

With reference to FIGS. 1-4, the compressor 10 may include a shell assembly 12, a bearing housing assembly 14, a motor assembly 16, a compression mechanism 18, a seal assembly 20, a plurality of bushing or sleeve guide assemblies 22, and a discharge valve assembly 26. The shell assembly 12 may house the bearing housing assembly 14, the motor assembly 16, the compression mechanism 18, the seal assembly 20, the plurality of bushing assemblies 22, and the discharge valve assembly 26.

The shell assembly 12 may generally form a compressor housing and may include a cylindrical shell 28, an end cap 32 at the upper end thereof, a transversely extending partition 34, and a base 36 at a lower end thereof. The end cap 32 and the partition 34 may generally define a discharge chamber 38 (i.e., a discharge-pressure region). The discharge chamber 38 may generally form a discharge muffler for the compressor 10. While illustrated as including the discharge chamber 38, it is understood that the present disclosure applies equally to direct discharge configurations. The shell assembly 12 may define an opening 40 in the end cap 32 forming a discharge outlet. The shell assembly 12 may additionally define a suction inlet (not shown) in communication with a suction chamber 39 (i.e., a suction-pressure region). The partition 34 may include a discharge passage 44 therethrough providing communication between the compression mechanism 18 and the discharge chamber 38.

The bearing housing assembly 14 may include a main bearing housing 46, a bearing 48, and a drive bushing 50. The main bearing housing 46 may be fixed to the shell 28 at a plurality of points in any desirable manner, such as staking, for example. The main bearing housing 46 may include a central body 54 with arms 56 extending radially outward from the central body 54. The central body 54 may include a bore defined by a circumferential wall 58 housing the bearing 48. The arms 56 may be engaged with the shell 28 to fixedly support the main bearing housing 46 within the shell 28. Each of the arms 56 may include a first aperture (or arm aperture) 66 extending therethrough.

As shown in FIG. 1, the motor assembly 16 may include a motor stator 72, a rotor 74, and a drive shaft 76. The motor stator 72 may be press fit into the shell 28. The rotor 74 may be press fit on the drive shaft 76 and the drive shaft 76 may be rotationally driven by the rotor 74. The drive shaft 76 may extend through the bore defined by the circumferential wall 58 and may be rotationally supported within the main bearing housing 46 by the bearing 48.

The drive shaft 76 may include an eccentric crank pin 78 having a flat 80 thereon. The drive bushing 50 may be located on the eccentric crank pin 78 and may be engaged with the compression mechanism 18. The main bearing housing 46 may define a thrust bearing surface 82 supporting the compression mechanism 18.

The compression mechanism 18 may include an orbiting scroll 84 and a non-orbiting scroll 86 meshingly engaged with one another. The orbiting scroll 84 may include an end plate 88 having a spiral vane or wrap 90 on the upper surface thereof and an annular flat thrust surface 92 on the lower surface. The thrust surface 92 may interface with the annular flat thrust bearing surface 82 on the main bearing housing 46. A cylindrical hub 94 may project downwardly from the thrust surface 92 and may have the drive bushing 50 rotatably disposed therein. The drive bushing 50 may include an inner bore receiving the crank pin 78. The crank pin flat 80 may drivingly engage a flat surface in a portion of the inner bore of the drive bushing 50 to provide a radially compliant driving arrangement. An Oldham coupling 96 may be engaged with the orbiting and non-orbiting scrolls 84, 86 (or with the orbiting scroll 84 and the main bearing housing 46) to prevent relative rotation between the orbiting and non-orbiting scrolls 84, 86.

The non-orbiting scroll 86 may include an end plate 98 defining a discharge passage 100 and having a spiral wrap 102 extending from a first side thereof, an annular recess 104 defined in a second side thereof opposite the first side, and a plurality of radially outwardly extending flanged portions 106 engaged with the plurality of bushing assemblies 22. The end plate 98 may additionally include a biasing passage (not shown) in fluid communication with the annular recess 104 and an intermediate compression pocket defined by the orbiting and non-orbiting scrolls 84, 86. The seal assembly 20 may form a floating seal assembly and may be sealingly engaged with the non-orbiting scroll 86 to define an axial biasing chamber 110 containing intermediate-pressure working fluid that biases the non-orbiting scroll 86 axially (i.e., in a direction parallel to the rotational axis of the drive shaft 76) toward the orbiting scroll 84. Each of the flanged portions 106 of the non-orbiting scroll 86 may include a second aperture (or flange aperture) 114.

Figure 2:
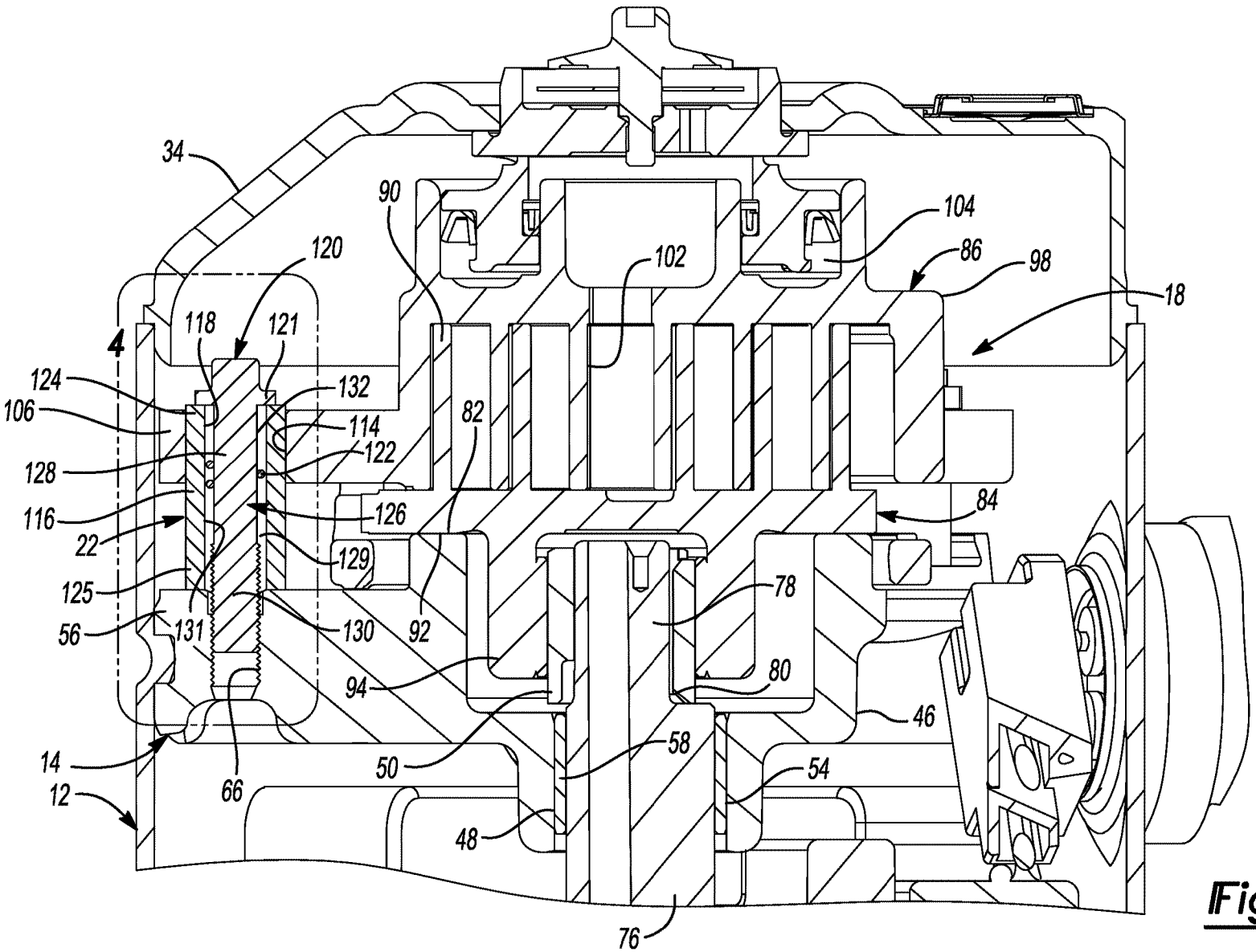
FIG. 2 is a cross-sectional view of a portion of the compressor indicated as area 2 in FIG. 1.
Figure 3:
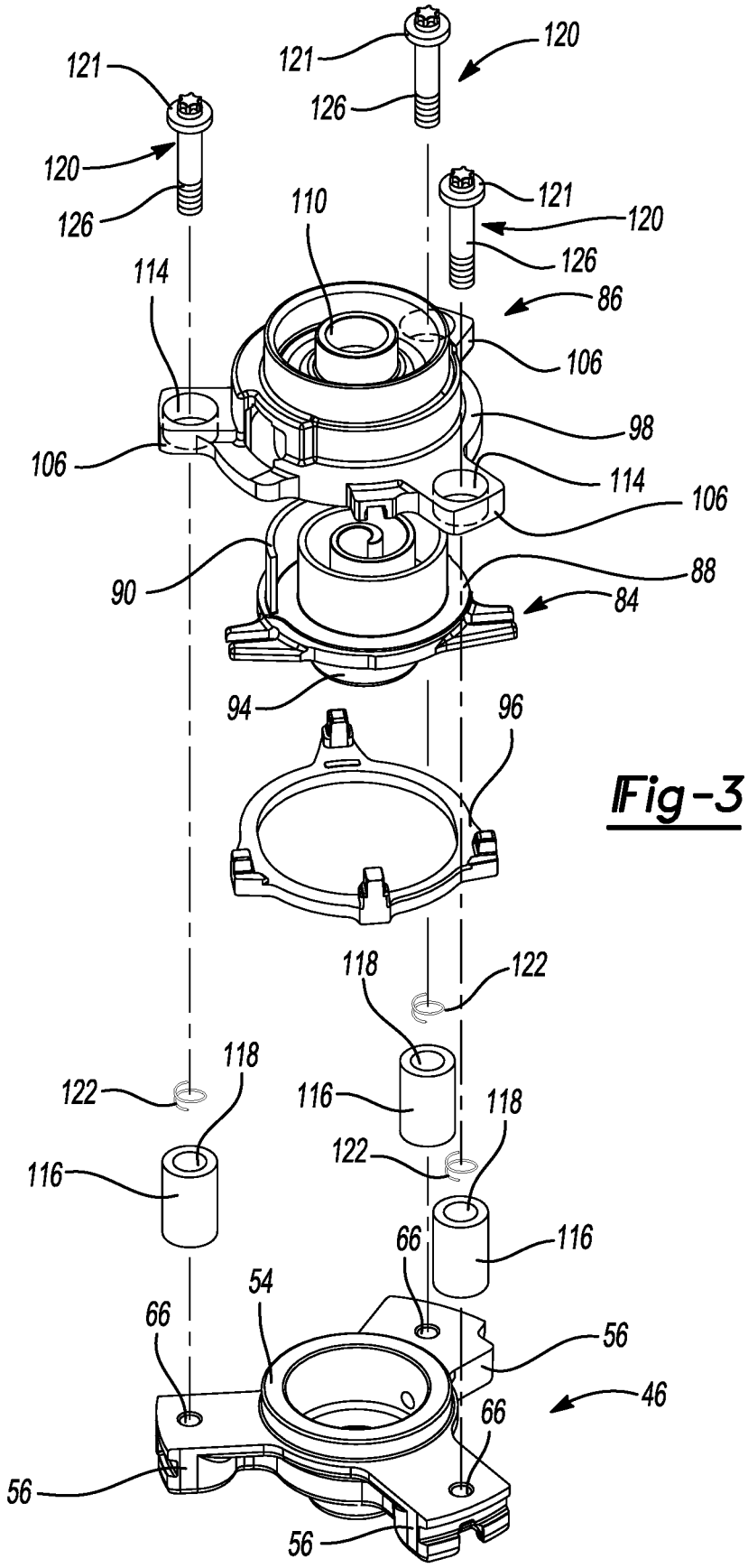
FIG. 3 is an exploded perspective view of a bearing housing, the sleeve guide assemblies and a compression mechanism of the compressor.

The plurality of bushing assemblies 22 may rotationally fix the non-orbiting scroll 86 relative to the main bearing housing 46 while allowing axial displacement of the non-orbiting scroll 86 relative to the main bearing housing 46. Each bushing assembly 22 may be received within a corresponding one of the flange apertures 114 of the non-orbiting scroll 86. Each bushing assembly 22 may include a bushing 116, a fastener 120 and a spacer 122. The bushing 116 may include a third aperture (or bushing aperture) 118. As shown in FIG. 2, a first end 124 of the bushing 116 may extend axially out of the corresponding flange aperture 114 and abut a head 121 of the fastener 120 (or a washer) such that the head 121 (or the washer) is slightly axially spaced apart from the flanged portion 106 of the non-orbiting scroll 86, thereby allowing axial movement of the non-orbiting scroll 86 relative to the main bearing housing 46. A second end 125 of the bushing 116 extends axially out of the corresponding flange aperture 114 and abuts against the corresponding arm 56 of the bearing housing 46.

Each fastener 120 may include the head 121 and a shaft 126. The shaft 126 may extend from the head 121 and through the bushing aperture 118 of the bushing 116, and may threadably engage the corresponding arm aperture 66 in the bearing housing 46 to rotatably secure the non-orbiting scroll 86 relative to the bearing housing 46. The shaft 126 may include an unthreaded portion 128 and a threaded portion 130. Clearance gaps 129 may be defined between an inner diametrical surface 131 of the bushing 116 and the shaft 126 (i.e., the clearance gaps 129 may be between the inner diametrical surface 131 of the bushing 116 and an outer diametrical surface 132 of the unthreaded portion 128 of the shaft 126 and/or between the inner diametrical surface 131 of the bushing 116 and the threaded portion 130 of the shaft 126. The threaded portion 130 may engage a threaded portion 134 of the corresponding arm aperture 66 in the bearing housing 46 to rotatably secure the non-orbiting scroll 86 relative to the bearing housing 46.

Figure 4B:
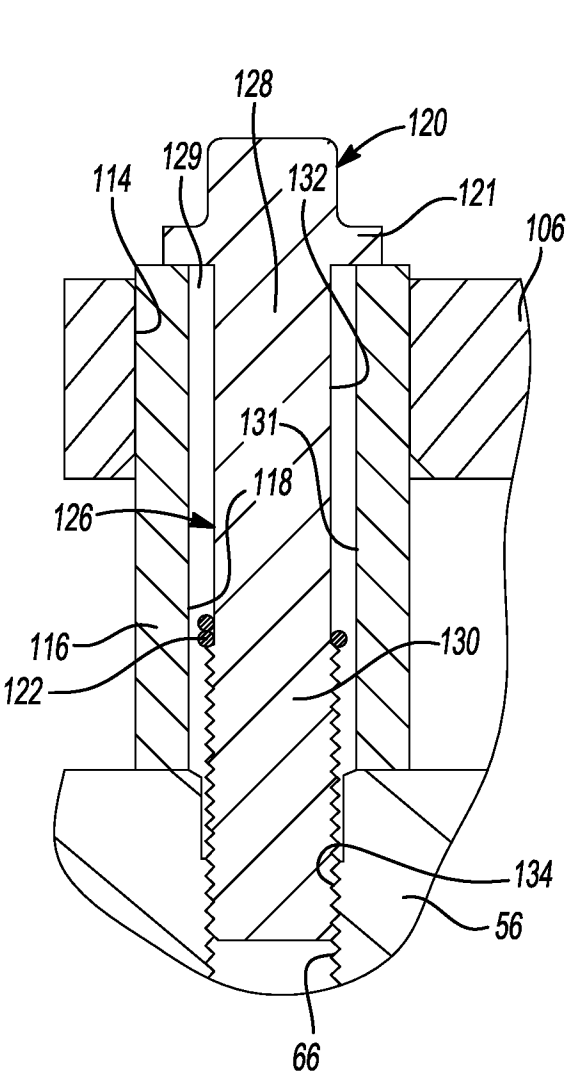
FIG. 4B is a cross-sectional view of a portion of yet another configuration of the compressor.
Figure 4A:
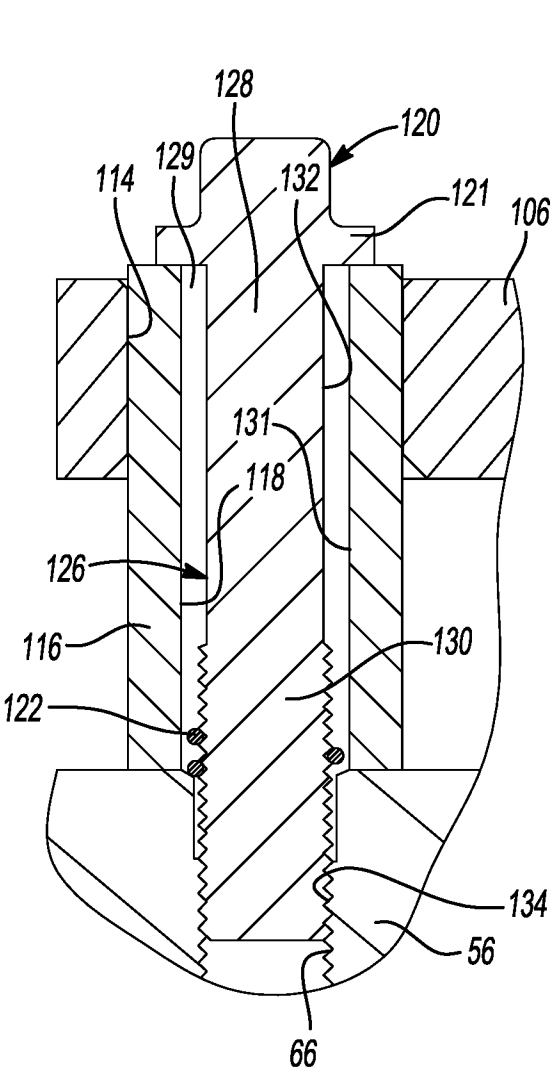
FIG. 4A is a cross-sectional view of a portion of another configuration of the compressor.
Figure 4:
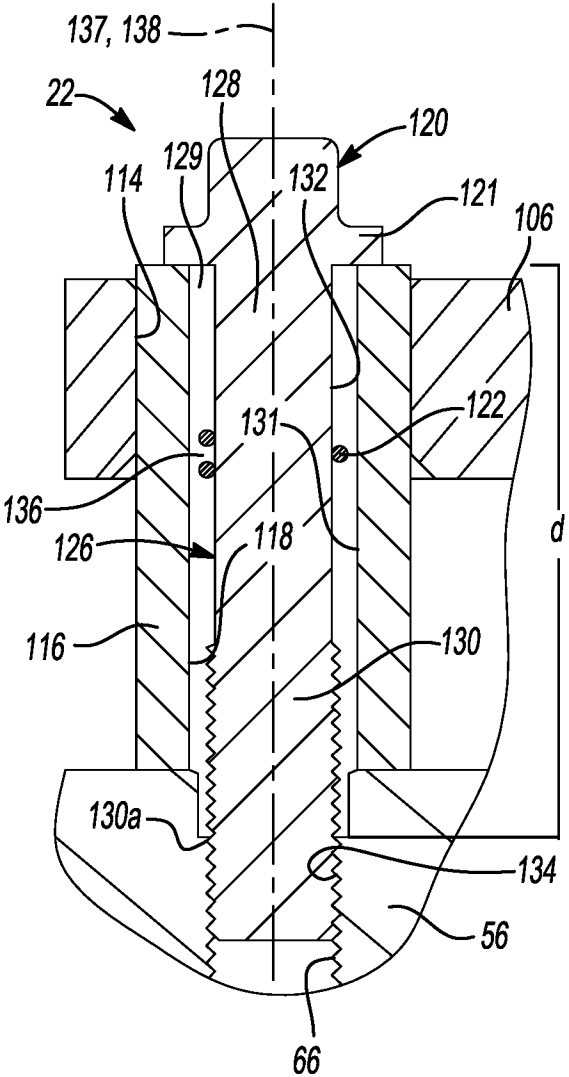
FIG. 4 is a cross-sectional view of a portion of the compressor indicated as area 4 in FIG. 2.

The spacer 122 may be disposed within the third aperture 118 of the bushing 116 and positioned between the bushing 116 and the fastener 120. The spacer 122 may be coupled to the shaft 126 of the fastener 120 such that a space or gap 136 (FIG. 4) is defined between the spacer 122 and the inner diametrical surface 131 of the bushing 116. A distance d may extend from where a first thread location 130*a* of the threaded portion 130 is engaged with the threaded portion 134 of the corresponding arm aperture 66 to the head 121 of the fastener 120. In other words, the distance d extends from the first thread location 130*a* to the head 121, where the first thread location 130*a* is the location closest to the head 121 at which a thread of the fastener 120 threadably engages a thread of the aperture 66. The spacer 122 may be coupled to the shaft 126 at a location between 50%-80% of the distance d from where the first thread location 130*a* of the threaded portion 130 is engaged with the threaded portion 134. This may reduce stress at the first thread location 130*a* during operation of the compressor 10. In FIG. 4, the spacer 122 is shown coupled to the unthreaded portion 128 of the shaft 126. In some configurations, however, the spacer 122 may be coupled to the threaded portion 130 (FIG. 4*a*), or partially to the unthreaded portion 128 and partially to the threaded portion 130 (FIG. 4*b*). In configurations where the spacer 122 is coupled to the threaded portion 130, the spacer 122 may be positioned in one or more thread troughs and/or on one or more thread peaks.

Figure 5:
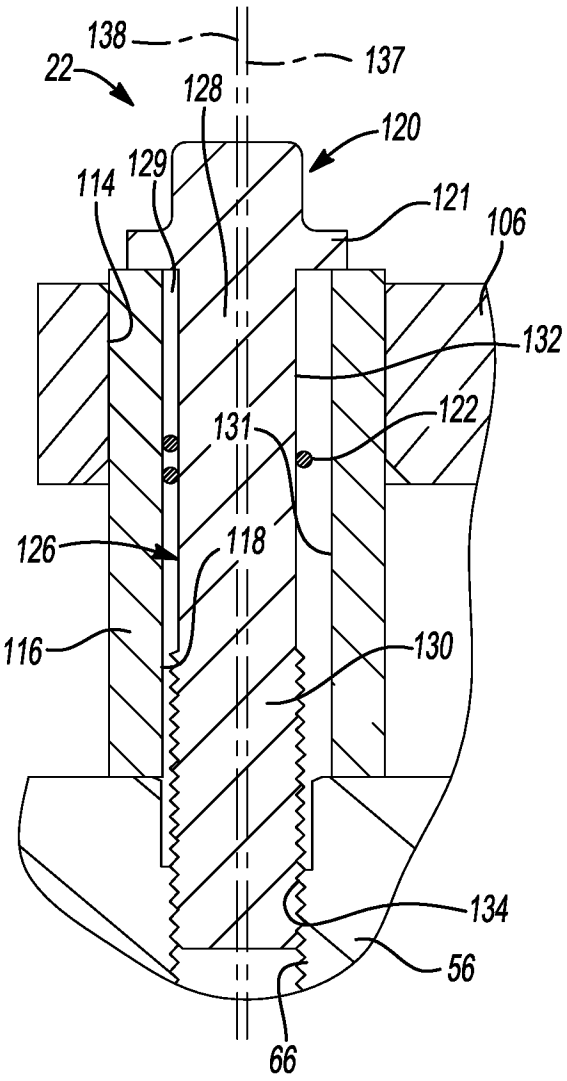
FIG. 5 is a cross-sectional view of a portion of the compressor showing a spacer of a guide assembly engaging a bushing of the guide assembly.

As shown in FIG. 5, the spacer 122 may be configured to engage the inner diametrical surface 131 of the bushing 116 during operation of the compressor 10 to prevent the shaft 126 of the fastener 120 from engaging the inner diametrical surface 131 of the bushing 116 (when the spacer 122 engages the inner diametrical surface 131 of the bushing 116, the gap 136 is defined by at least a portion of the spacer 122 and at least a portion of the bushing 116). That is, the fastener 120 may deflect during operation of the compressor 10, which will cause the fastener 120 to move closer to the bushing 116. Due to the spacer 122 being coupled to the fastener 120, the spacer 122 may engage the bushing 116 during deflection of the fastener 120, which will prevent the fastener 120 and the bushing 116 from coming in contact with each other. In this way, the spacer 122 reduces clearance between the bushing 116 and the fastener 120, which reduces eccentricity between the bushing 116 and the fastener 120. The spacer 122 also restricts radial misalignment between a first longitudinal axis 137 of the bushing 116 and a second longitudinal axis 138 of the shaft 126 of the fastener 120, which reduces stress, noise and vibration during operation of the compressor 10.

As shown in FIG. 4, when the bushing assembly 22 is assembled to the non-orbiting scroll 86 and the main bearing housing 46, the first longitudinal axis 137 of the bushing 116 and the second longitudinal axis 138 of the shaft 126 are aligned with each other. In some configurations, however, the first longitudinal axis 137 of the shaft 126 and the second longitudinal axis 138 of the bushing 116 may be slightly radially offset or misaligned from each other.

As shown in FIGS. 1-5, the spacer 122 is a coiled wire. In some configurations, the spacer 122 may be a split spring bushing, a continuous annular bushing, a nut, a wave spring or any other suitable member that may be securely coupled to the shaft 126 and engage the bushing 116 during operation of the compressor 10 to restrict radial misalignment between the first longitudinal axis 137 of the bushing 116 and the second longitudinal axis 138 of the fastener 120.

Figure 6:
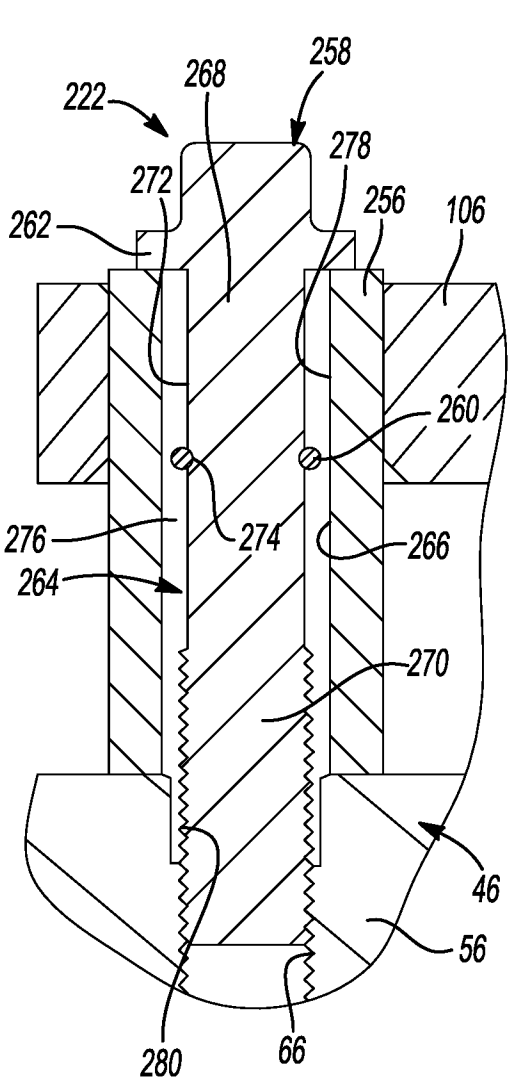
FIG. 6 is a cross-sectional view of another bushing assembly.

With reference to FIG. 6, another bushing assembly 222 is provided. The bushing assembly 222 may be incorporated into the compressor 10 instead of bushing assembly 22. The structure and function of the bushing assembly 222 may be similar or identical to bushing assembly 22 described above, apart from any exception noted below.

Each bushing assembly 222 may include a bushing 256, a fastener 258 and a spacer 260. The structure and function of the bushing 256 may be similar or identical to bushing 116 described above, and therefore, will not be described again in detail.

Each fastener 258 may include a head 262 and a shaft 264. The shaft 264 may extend from the head 262 and through a bushing aperture 266 of the bushing 256, and may threadably engage the corresponding arm aperture 66 in the bearing housing 46 to rotatably secure the non-orbiting scroll 86 relative to the bearing housing 46. The shaft 264 may include an unthreaded portion 268 and a threaded portion 270. The unthreaded portion 268 may include an outer diametrical surface 272 that has annular groove 274 formed therein. Clearance gaps 276 may be defined between an inner diametrical surface 278 of the bushing 256 and the shaft 264 (i.e., the clearance gaps 276 may be between the inner diametrical surface 278 of the bushing 256 and the outer diametrical surface 272 of the unthreaded portion 268 of the shaft 264 and/or between the inner diametrical surface 278 of the bushing 256 and the threaded portion 270 of the shaft 264). The threaded portion 270 may engage a threaded portion 280 of the corresponding arm aperture 66 in the bearing housing 46 to rotatably secure the non-orbiting scroll 86 relative to the bearing housing 46.

The spacer 260 may be disposed within the groove 274 of the unthreaded portion 268 and positioned between the bushing 256 and unthreaded portion 268 of the fastener 258. The spacer 260 may be configured to engage the inner diametrical surface 278 of the bushing 256 during operation of the compressor 10 to prevent the shaft 264 of the fastener 258 from engaging the inner diametrical surface 278 of the bushing 256. The structure and function of the spacer 260 may be similar or identical to spacer 122 described above, and therefore, will not be described again in detail.

Figure 7:
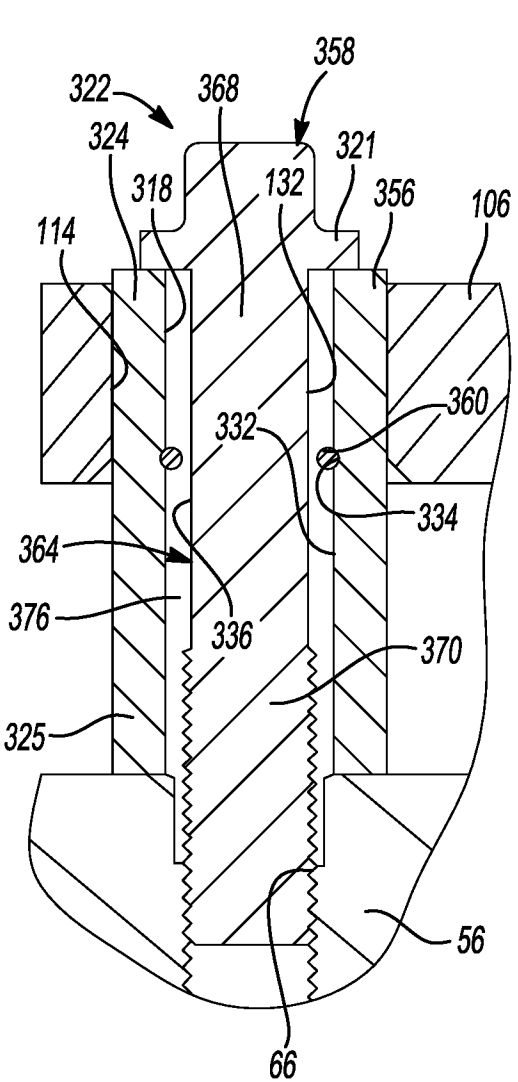
FIG. 7 is a cross-sectional view of yet another bushing assembly.

With reference to FIG. 7, another bushing assembly 322 is provided. The bushing assembly 322 may be incorporated into the compressor 10 instead of bushing assemblies 22, 222. The structure and function of the bushing assembly 322 may be similar or identical to bushing assemblies 22, 222 described above, apart from any exceptions noted below.

Each bushing assembly 322 may include a bushing 356, a fastener 358 and a spacer 360. The bushing 356 may include a third aperture (or bushing aperture) 318. A first end 324 of the bushing 356 may extend axially out of the corresponding flange aperture 114 and abut a head 321 of the fastener 358 such that the head 321 is slightly axially spaced apart from the flanged portion 106 of the non-orbiting scroll 86, thereby allowing axial movement of the non-orbiting scroll 86 relative to the main bearing housing 46. A second end 325 of the bushing 356 extends axially out of the corresponding flange aperture 114 and abuts against the corresponding arm 56 of the bearing housing 46. The bushing 356 may include an inner diametrical surface 332 that has annular groove 334 formed therein.

Each fastener 358 may include the head 321 and a shaft 364. The shaft 364 may extend from the head 321 and through the bushing aperture 318 of the bushing 356, and may threadably engage the corresponding arm aperture 66 in the bearing housing 46 to rotatably secure the non-orbiting scroll 86 relative to the bearing housing 46. The shaft 364 may include an unthreaded portion 368 and a threaded portion 370. Clearance gaps 376 may be defined between the inner diametrical surface 332 of the bushing 356 and the shaft 364 (i.e., the clearance gaps 376 may be between the inner diametrical surface 332 of the bushing 356 and an outer diametrical surface 336 of the unthreaded portion 368 of the shaft 364 and/or between the inner diametrical surface 332 of the bushing 356 and the threaded portion 370 of the shaft 364).

The spacer 360 may be disposed within the groove 334 of the bushing 356 and positioned between the bushing 356 and the shaft 364 of the fastener 358. The spacer 360 may be configured to engage the shaft 364 of the fastener 358 during operation of the compressor 10 to prevent the shaft 364 of the fastener 358 from engaging the inner diametrical surface 332 of the bushing 356. The structure and function of the spacer 360 may be similar or identical to spacers 122, 260 described above, and therefore, will not be described again in detail.

Figure 8:
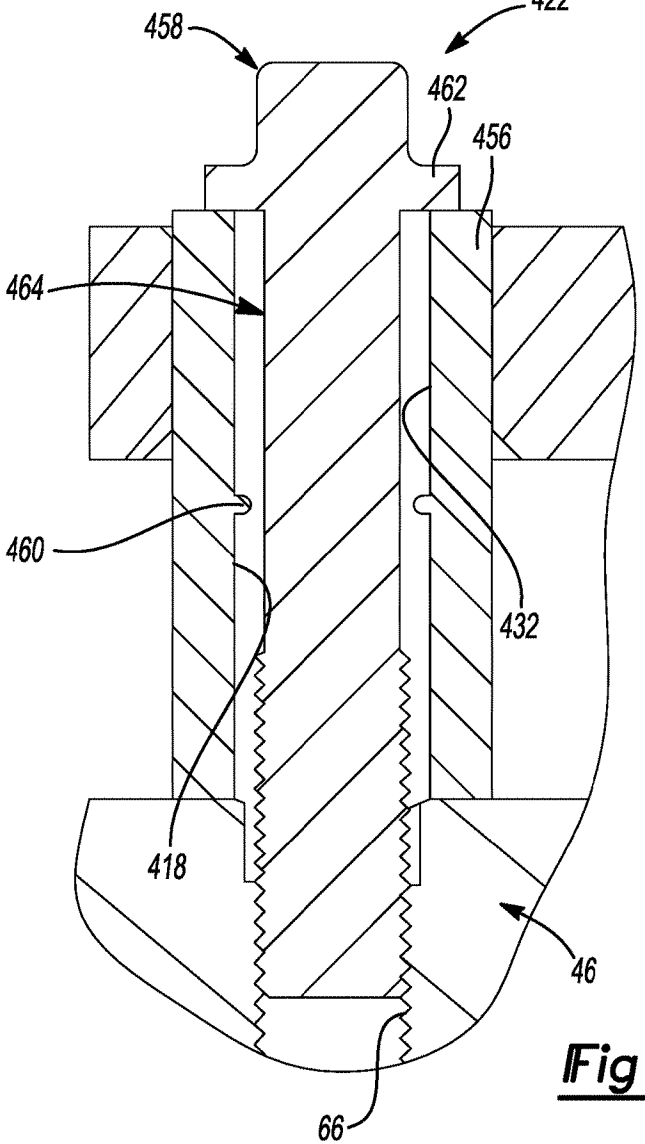
FIG. 8 is a cross-sectional view of yet another bushing assembly.

With reference to FIG. 8, another bushing assembly 422 is provided. The bushing assembly 422 may be incorporated into the compressor 10 instead of bushing assemblies 22, 222, 322. The structure and function of the bushing assembly 422 may be similar or identical to bushing assemblies 22, 222, 322 described above, apart from any exceptions noted below.

Each bushing assembly 422 may include a bushing 456, a fastener 458 and a spacer 460. The bushing 456 may include a third aperture (or bushing aperture) 418 defining an inner diametrical surface 432.

Each fastener 458 may include a head 462 and a shaft 464. The shaft 464 may extend from the head 462 and through the bushing aperture 418 of the bushing 456, and may threadably engage the corresponding arm aperture 66 in the bearing housing 46 to rotatably secure the non-orbiting scroll 86 relative to the bearing housing 46. The spacer 460 may extend radially inwardly from the inner diametrical surface 432 of the bushing 456 toward the fastener 458 and may be positioned between the bushing 456 and the fastener 458. In some configurations, the spacer 460 is an annular ridge that is integrally formed with the bushing 456.

The spacer 460 may be configured to engage the shaft 464 of the fastener 458 during operation of the compressor 10 to prevent the shaft 464 of the fastener 458 from engaging the inner diametrical surface 432 of the bushing 456. In this way, the spacer 460 restricts radial misalignment between a first longitudinal axis of the bushing 456 and a second longitudinal axis of the shaft 464 of the fastener 458, which reduces stress, noise and vibration during operation of the compressor 10.

Figure 9:
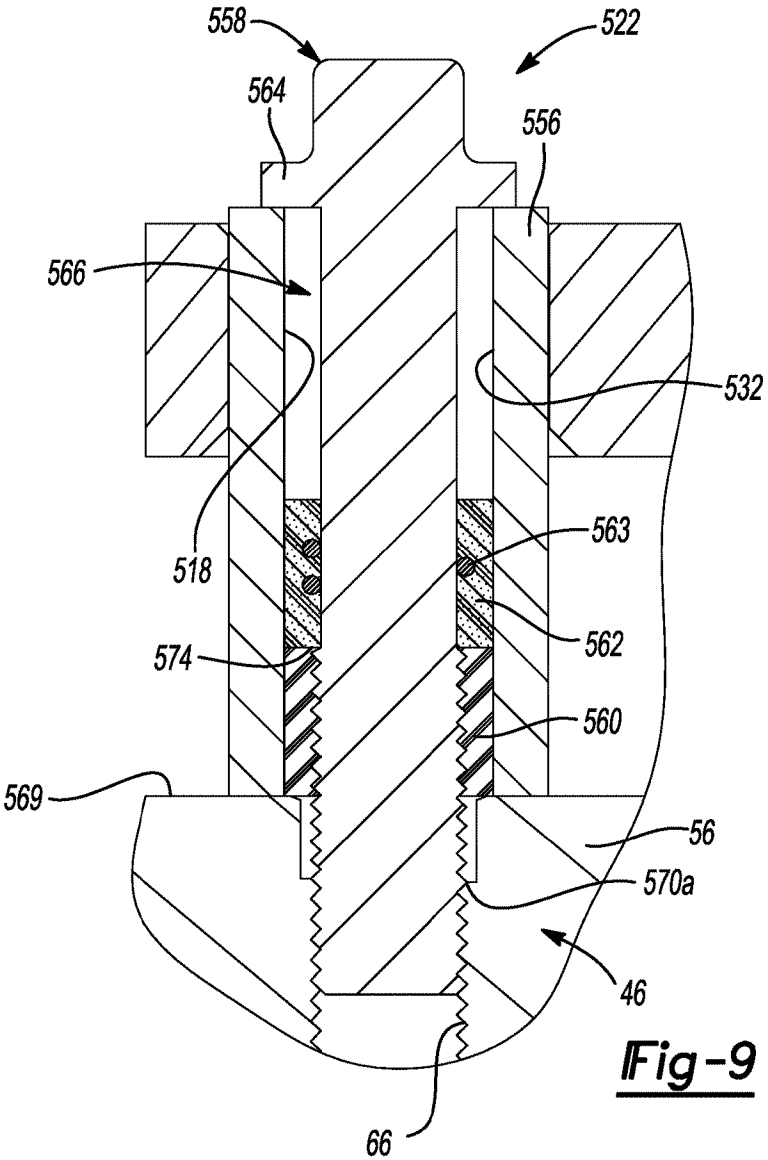
FIG. 9 is a cross-sectional view of yet another bushing assembly.

With reference to FIG. 9, another bushing assembly 522 is provided. The bushing assembly 522 may be incorporated into the compressor 10 instead of bushing assemblies 22, 222, 322, 422. The structure and function of the bushing assembly 522 may be similar or identical to bushing assemblies 22, 222, 322, 422 described above, apart from any exceptions noted below.

Each bushing assembly 522 may include a bushing 556, a fastener 558, a first spacer 560, a second spacer 562, and a third spacer 563. The bushing 556 may include a third aperture (or bushing aperture) 518 defining an inner diametrical surface 532.

The fastener 558 may include a head 564 and a shaft 566. The shaft 566 may extend from the head 564 and through the bushing aperture 518 of the bushing 556, and may threadably engage the corresponding arm aperture 66 in the bearing housing 46 to rotatably secure the non-orbiting scroll 86 relative to the bearing housing 46. The first spacer 560 may be disposed within the third aperture 518 of the bushing 556 and positioned between the bushing 556 and the fastener 558. The first spacer 560 may also be positioned on a surface 569 of the corresponding arm 56 of the bearing housing 46. The first spacer 560 may be annular-shaped and may be made of a soft, compressible material (e.g., foam). The first spacer 560 fills the variable clearance around the shaft 566 of the fastener 558 such that there is no clearance gap between the first spacer 560 and the inner diametrical surface 532 of the bushing 556 or between the first spacer 560 and the shaft 566 of the fastener 558.

The third spacer 563 may be similar or identical to spacer 122 described above. The third spacer 563 limits eccentricity of the bushing 556 relative to the fastener 558 during installation of the bushing assembly 522 into the compressor 10.

The second spacer 562 may be made of an adhesive material such as an epoxy or other similar material that may be a liquid in a pre-cured state and a solid in a cured state. When in the pre-cured state, the third spacer 562 may flow into the bushing aperture 518 and bond to the fastener 558 and an axial end 574 of the first spacer 560. When cured, the second spacer 562 is solid. The solid second spacer 562 may fill the variable clearance between the shaft 566 and the inner diametrical surface 532 of the bushing 556 to provide a hard spacer that contacts and supports the shaft 566 of the fastener 558 all the way around (360 degrees around) the diameter of the shaft 566. In other words, the second spacer 562 fills the variable clearance around the shaft 566 of the fastener 558 such that there is no clearance gap between the second spacer 562 and the inner diametrical surface 532 of the bushing 556 or between the second spacer 562 and the shaft 566 of the fastener 558. In this way, the solid second spacer 562 restricts radial motion between a first longitudinal axis of the bushing 556 and a second longitudinal axis of the shaft 566 of the fastener 558 during operation of the compressor 10 and may reduce stress of a first thread location 570*a*. The third spacer 563 may restrict radial misalignment between a first longitudinal axis of the bushing 556 and a second longitudinal axis of the shaft 566 of the fastener 558 and may reduce stress at the first thread location 570*a* during operation of the compressor 10. The third spacer 563 may be embedded in the second spacer 562 when the second spacer 562 is fully cured.

The solid second spacer 562 is relatively hard and not easily compressible when cured (i.e., the cured second spacer 562 has a higher rigidity than the first spacer 560). It should also be understood that a distance between the surface 569 of the corresponding arm 56 of the bearing housing 46 and a location along a length of the fastener 558 where the second spacer 562 is coupled to the fastener 558 is determined by an axial length of the first spacer 560.

Figure 10:
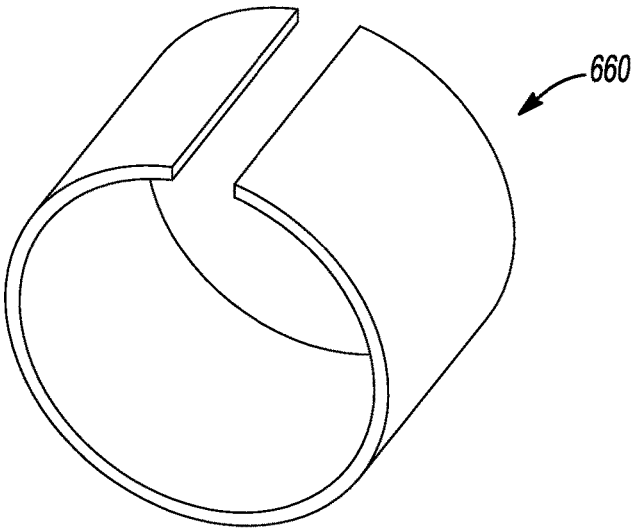
FIG. 10 is a perspective view of another spacer that can be incorporated into the bushing assembly.

With reference to FIG. 10, another spacer 660 is provided. The spacer 660 may be a split spring bushing and may be incorporated into the bushing assembly 22 instead of spacer 122. The structure and function of the spacer 660 may be similar or identical to the spacer 122 described above, and therefore, will not be described again in detail. In some configurations, the spacer 660 may be a continuous (uninterrupted) annular bushing (rather than a split spring bushing).

Figure 11:
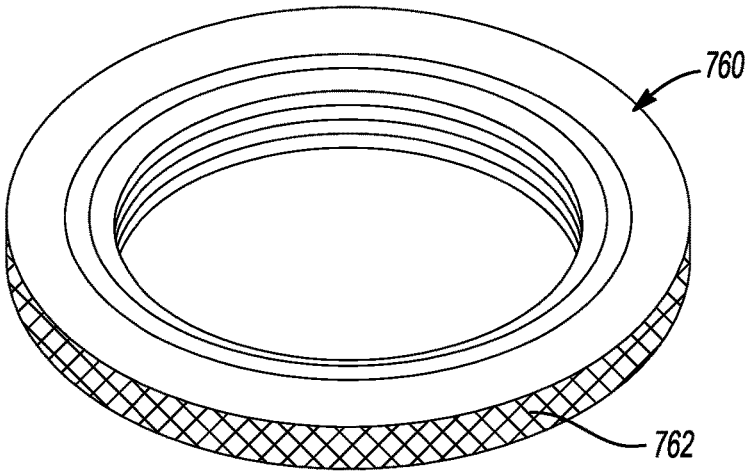
FIG. 11 is a perspective view of yet another spacer that can be incorporated into the bushing assembly.

With reference to FIG. 11, another spacer 760 is provided. The spacer 760 may be incorporated into the bushing assembly 22 instead of spacer 122.

The spacer 760 may be a thin nut that is threadably engaged with the threaded portion 130 of the fastener 120. In this way, the spacer 760 restricts radial misalignment between the first longitudinal axis 137 of the bushing 116 and the second longitudinal axis 138 of the shaft 126 of the fastener 120, which reduces stress, noise and vibration during operation of the compressor 10. An outer diametrical surface of the spacer 760 may including knurling 762.

Figure 12:
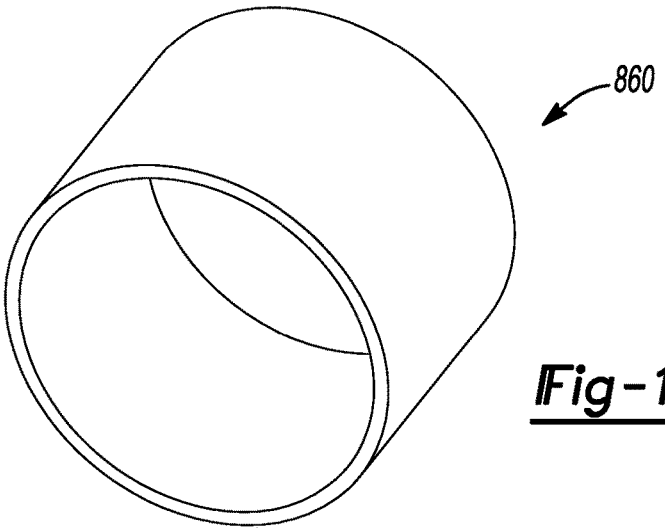
FIG. 12 is a perspective view of yet another spacer that can be incorporated into the bushing assembly.

With reference to FIG. 12, another spacer 860 is provided. The spacer 860 may be an uninterrupted annular bushing and may be incorporated into the bushing assembly 22 instead of spacer 122. A heat-shrink assembly method may be employed to install the spacer 860 onto the shaft 126 of fastener 120. Alternatively, the spacer 860 could be press fit onto the shaft 126. The positioning and function of the spacer 860 may be similar or identical to the spacer 122 described above.

Figure 13:
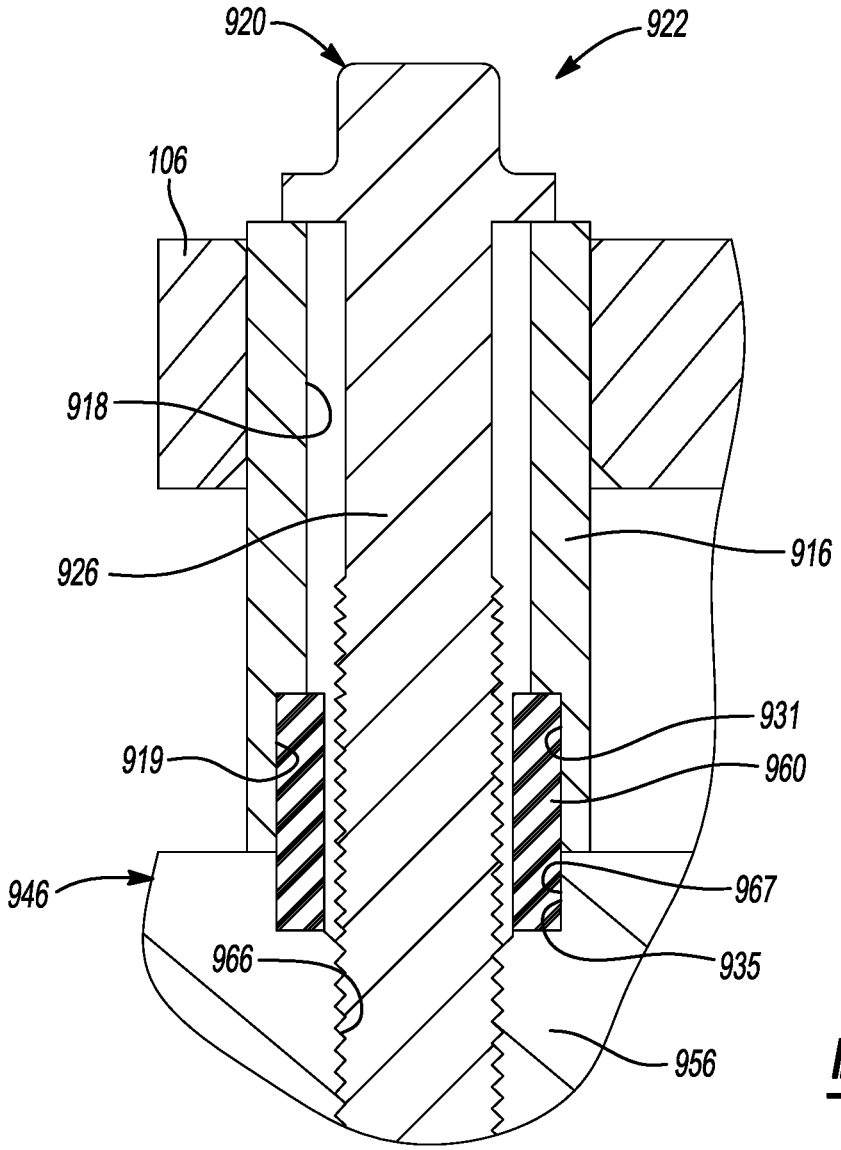
FIG. 13 is a cross-sectional view of yet another bushing assembly.

With reference to FIG. 13, another bushing assembly 922 and bearing housing 946 provided. The bushing assembly 922 and bearing housing 946 may be incorporated into the compressor 10 instead of the bushing assembly 22 and bearing housing 46. The structure and function of the bushing assembly 922 and bearing housing 946 may be similar or identical to bushing assembly 22 and bearing housing 946 described above, apart from any differences shown in the figures and/or described below.

The bushing assembly 922 may include a bushing 916, a fastener 920, and a spacer 960. The bushing 916 includes an aperture 918 having a counterbore 919. Arms 956 of the bearing housing 946 includes an aperture 966 having a counterbore 967. A portion of the spacer 960 may be disposed within the counterbore 919 of the aperture 918 of the bushing 916 and another portion of the spacer 960 may be disposed within the counterbore 967 of the aperture 966 of the bearing housing 946. The spacer 960 may be coupled (e.g., via press fit or heat-shrink assembly, for example) to the bushing 916 or to the bearing housing 946. The spacer 960 may engage an inner diametrical surface 931 of the counterbore 919 of the bushing 916 and an inner diametrical surface 935 of the counterbore 967 of the bearing housing 946. A clearance gap may exist radially between the spacer 960 and the shaft 926 of the fastener 920. A clearance gap may also exist radially between the bushing 916 and the shaft 926 of the fastener 920. The spacer 960 may restrict radial misalignment between a longitudinal axis of the bushing 916 and a longitudinal axis of the aperture 966 of the bearing housing 946. Furthermore, the spacer 960 may restrict radial misalignment between the longitudinal axis of the bushing 916 and a longitudinal axis of a shaft 926 of the fastener 920. The spacer 960 could be a continuous annular bushing, a split spring bushing, a coiled wire, a nut, a wave spring or any other suitable member.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell;

a bearing housing supported within the shell, the bearing housing including a central body and a plurality of arms extending radially outwardly from the central body, each of the arms having a first aperture;

an orbiting scroll supported on the bearing housing;

a non-orbiting scroll meshingly engaged with the orbiting scroll and including a plurality of second apertures, each second aperture receiving a bushing defining a first longitudinal axis and a fastener defining a second longitudinal axis, the fastener extending through the bushing and into a corresponding one of the first apertures in the bearing housing to rotatably secure the non-orbiting scroll relative to the bearing housing; and a spacer disposed radially between the bushing and the fastener of each second aperture and configured to engage one of the bushing and the fastener to restrict radial misalignment between the first longitudinal axis of the bushing and the second longitudinal axis of the fastener, wherein a clearance gap is disposed radially between an inner diametrical surface of the bushing and a shaft of the fastener, wherein the spacer is disposed within the clearance gap, and wherein the spacer and the clearance gap allow relative radial movement between the bushing and the fastener.

2. The compressor of claim 1, wherein the spacer is coupled to the fastener and is configured to engage the bushing to restrict radial misalignment between the first longitudinal axis of the bushing and the second longitudinal axis of the fastener.

3. The compressor of claim 2, wherein the shaft of the fastener includes an unthreaded portion, and wherein the spacer is coupled to the unthreaded portion of the fastener.

4. The compressor of claim 2, wherein the spacer is coupled to the fastener at a location between 50%-80% of a distance from a location where a first thread of the fastener is engaged with a threaded portion of the first aperture to a head of the fastener.

5. The compressor of claim 2, wherein the fastener includes a threaded portion, and wherein the spacer is coupled to the threaded portion of the fastener.

6. The compressor of claim 2, wherein the fastener includes a threaded portion and an unthreaded portion, and wherein the spacer is coupled to the threaded portion and the unthreaded portion of the fastener.

7. The compressor of claim 2, wherein the fastener includes an unthreaded portion, and wherein the spacer is disposed within an annular groove formed in an outer diametrical surface of the unthreaded portion.

8. The compressor of claim 1, wherein the spacer is coupled to the bushing and is configured to engage the fastener to restrict radial misalignment between the first longitudinal axis of the bushing and the second longitudinal axis of the fastener.

9. The compressor of claim 8, wherein the bushing includes an inner diametrical surface having an annular groove formed therein, and wherein the spacer is disposed within the annular groove.

10. The compressor of claim 8, wherein the spacer extends radially inwardly from an inner diametrical surface of the bushing and is configured to engage an unthreaded portion of the fastener.

11. The compressor of claim 1, wherein the spacer is integrally formed with the bushing.

12. A compressor comprising:

a shell;

a bearing housing fixed within the shell, the bearing housing including a central body and a plurality of arms extending radially outward from the central body, each of the arms having a first aperture;

a non-orbiting scroll including a plurality of second apertures;

an orbiting scroll supported on the bearing housing and meshingly engaged with the non-orbiting scroll;

a plurality of bushings each having a third aperture, each of the second apertures in the non-orbiting scroll receiving one of the bushings;

a plurality of fasteners rotatably securing the non-orbiting scroll relative to the bearing housing, each of the fasteners extending through the third aperture of a corresponding bushing and received in a corresponding one of the first apertures in the bearing housing; and a plurality of first spacers, each of the first spacers received in the third aperture of a corresponding bushing and configured to engage one of the corresponding bushing and a corresponding fastener to restrict radial misalignment between a first longitudinal axis of the corresponding bushing and a second longitudinal axis of the corresponding fastener, wherein a clearance gap is disposed radially between an inner diametrical surface of the corresponding bushing and a shaft of the corresponding fastener, wherein each of the first spacers are disposed within the corresponding clearance gap, and wherein the corresponding spacer and the corresponding clearance gap allow relative radial movement between the corresponding bushing and the corresponding fastener.

13. The compressor of claim 12, wherein the clearance gap is defined by the inner diametrical surface of the bushing and at least a portion of a respective spacer.

14. A compressor comprising:

a shell;

a bearing housing fixed within the shell, the bearing housing including a central body and a plurality of arms extending radially outward from the central body, each of the arms having a first aperture;

a non-orbiting scroll including a plurality of second apertures;

an orbiting scroll supported on the bearing housing and meshingly engaged with the non-orbiting scroll;

a plurality of bushings each having a third aperture, each of the second apertures in the non-orbiting scroll receiving one of the bushings;

a plurality of fasteners rotatably securing the non-orbiting scroll relative to the bearing housing, each of the fasteners extending through the third aperture of a corresponding bushing and received in a corresponding one of the first apertures in the bearing housing; and a plurality of first spacers, each of the first spacers received in the third aperture of a corresponding bushing and configured to engage one of the corresponding bushing and the corresponding fastener to restrict radial misalignment and allow relative radial movement between a first longitudinal axis of the corresponding bushing and a second longitudinal axis of the shaft of the corresponding fastener, wherein the plurality of first spacers are coiled wires.

* * * * *